US005553332A

United States Patent [19]

Hazard

[11] Patent Number: 5,553,332

[45] Date of Patent: Sep. 10, 1996

[54] TOILET SEAT HANDLE OF UNITARY CONSTRUCTION

[76] Inventor: James T. Hazard, 347 Kenwood Way, Louisville, Ky. 40215

[21] Appl. No.: 331,700

[22] Filed: Oct. 31, 1994

Related U.S. Application Data

[63] Continuation-in-part of Ser. No. 906,562, Jun. 20, 1992, abandoned.

[51] Int. Cl.[6] ..... A47K 13/10

[52] U.S. Cl. ..... 4/246.1

[58] Field of Search ..... 4/246.1; 16/110 R, 16/114 R, 116 A, 122, 124; 200/331

[56] References Cited

U.S. PATENT DOCUMENTS

| | | | |
|---|---|---|---|
| 1,999,555 | 4/1935 | Adams | 4/246.1 |
| 3,191,193 | 6/1965 | Bogenberger | 16/124 X |
| 3,717,884 | 2/1973 | Mantooth | 4/246.1 |
| 3,935,601 | 2/1976 | Hermann | 4/246.1 |
| 4,574,401 | 3/1986 | Nakajima | 4/246.1 |
| 4,742,582 | 5/1988 | Giallourakis | 4/246.1 |
| 4,875,251 | 10/1989 | Hazard | 4/246.1 |
| 5,124,513 | 7/1992 | Blair | 200/331 |

FOREIGN PATENT DOCUMENTS

| | | | |
|---|---|---|---|
| 9111949 | 8/1991 | WIPO | 4/246.1 |

*Primary Examiner*—Charles E. Phillips

*Attorney, Agent, or Firm*—Middleton & Reutlinger; Charles G. Lamb

[57] ABSTRACT

A toilet seat handle device for attachment to a toilet seat as an aid to raising and lowering the toilet seat without having to actually touch the seat. The handle is attached at one of its ends to the toilet seat and the other end projects outwardly beyond the periphery thereof wherein the outwardly extending portion is made from a flexible material.

5 Claims, 1 Drawing Sheet

TOILET SEAT HANDLE OF UNITARY CONSTRUCTION

CROSS REFERENCE TO RELATED APPLICATIONS

This is a continuation-in-part patent application from Ser. No. 07/906,562; filed Jun. 20, 1992 now abandoned.

BACKGROUND OF THE INVENTION

1. Field of the Invention

The present invention relates to toilet seat handles and more particularly to a handle for attachment to a toilet seat which is flexible and visible in the dark.

2. Discussion of the Prior Art

Toilet seats, by the very nature of use, are unsanitary as few people, if any, disinfect them after use. And, these seats are mounted to be raised and lowered. In raising and lowering, it is necessary for people to touch the seat. Thus, there have been a number of suggestions for toilet seat handles whereby the seats may be raised and lowered without fingers and hands of people raising and lowering, coming in contact with the toilet seat. However, many of these previously designed toilet seat handles did not find acceptance.

One early toilet seat issued to Adams, U.S. Pat. No. 1,999,555, teaches a deodorizing or disinfecting toilet seat handle of L-shaped design wherein one leg of the L is attached to the toilet seat and the other leg of the L is used as a handle to lift the seat. U.S. Pat. No. 4,574,401 to Nakajima teaches a removable toilet seat handle attached to the underside of the seat or lid wherein the handle portion includes a longitudinally extending cylindrically shaped rod portion as a means to lift the seat. U.S. Pat. No. 3,717,884 to Mantooth teaches a toilet seat handle wherein the lifting portion is a laterally projecting hand grip having top and bottom ribs in the form of a closed loop. U.S. Pat. No. 4,742,582 to Giallourkis teaches a sanitary seat handle that is made from a rigid material and includes a scent dispersing means therein. U.S. Pat. No. 4,875,251 teaches a toilet seat handle of unitary construction wherein the handle portion is a cylindrical member which projects outwardly beyond the periphery of the toilet seat. Moreover, this patent teaches the inclusion of a material that is visible in the dark in the handle portion. However, none of these references teach or recognize one major problem in their use. That is, when people come near to or are in contact with the toilet seat during use, invariably they rub their legs against or have their legs come in contact with the handle. In all instances the handles are of somewhat rigid construction and therefore, when people come in contact with them, they can receive bruises and cuts or at least experience same sort of discomfort from hitting or rubbing up against these outwardly extending portions of the toilet seat handle.

SUMMARY OF THE INVENTION

The present invention recognizes the problem of prior art handles, particularly in regards to the rigid nature of these handles which present problems when a toilet seat is in use.

The present invention provides a toilet seat handle which can be located about the periphery of the seat in any location convenient to the user and the lifting or handle portion of the seat handle is flexible so that upon coming into contact with the leg of a person when using the seat, the handle portion yields to the contact.

More particularly, the present invention provides a toilet seat handle device for attachment to a toilet seat as an aid to raising and lowering the toilet seat comprising a base portion with upper and lower planar surfaces configured to fit with the upper planar surface against the bottom side of the toilet seat; means for attaching the base portion to the bottom side of the toilet seat; and, a flexible handle portion unitarily constructed with the base portion so as to have a first end affixed to the base portion and a second end extending outwardly from the base portion. The handle portion may also include a material that is visible in the dark.

BRIEF DESCRIPTION OF THE DRAWINGS

A better understanding of the invention will be had upon reference to the following description in conjunction with the drawings in which like numerals refer to like parts and wherein.

DESCRIPTION OF THE PREFERRED EMBODIMENT

Figure 1:
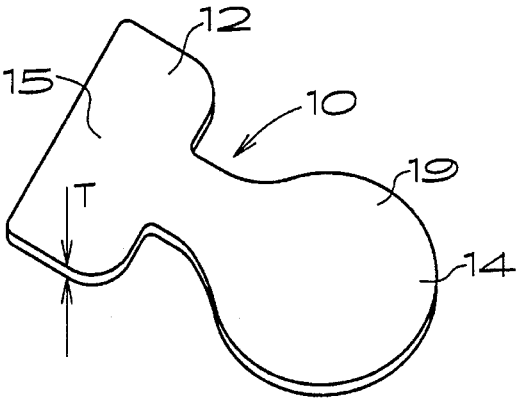
FIG. 1 is a perspective view of one preferred handle device of the present invention showing the bottom side of the handle device.
Figure 2:
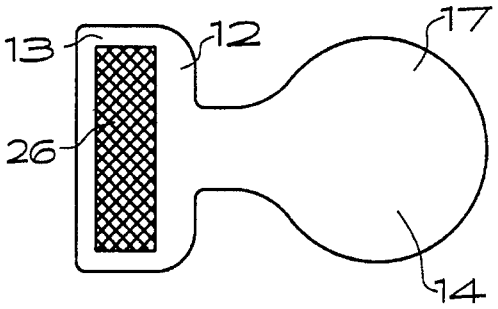
FIG. 2 is a top view of the handle device of FIG. 1.
Figure 4:
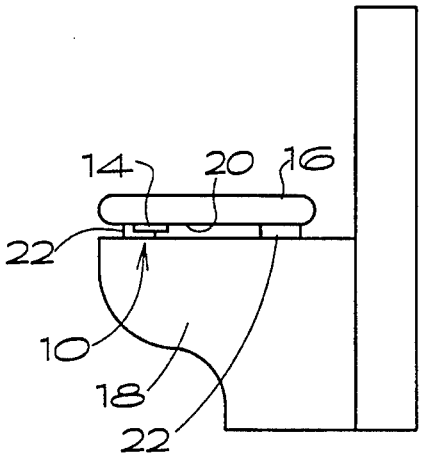
FIG. 4 is a side view of the toilet seat as seen in the direction of arrows 4—4 in FIG. 3 with the handle device of the present invention installed thereon.

FIGS. 1 and 2 show one preferred embodiment of a toilet seat handle of the present invention generally denoted by the numeral 10. The handle 10 comprises a base portion 12 and a handle portion 14 unitarily attached to and extending from the base portion 12. The base portion 12 is provided with an upper planar surface 13 and a lower planar surface 15 wherein the upper planar surface is configured so as to fit against the bottom side 20 of a toilet seat 16 (FIG. 4). The handle portion is also provided with an upper planar surface 17 and a lower planar surface 19 wherein the upper planar surface 17 of the handle 14 is in the same plan as the upper planar surface 13 of the base portion 12. And, the lower planar surface 19 of the handle portion 14 is in the same plane as the lower planar surface 15 of the base portion 12. Preferably, the thickness T of the toilet seat handle is in the range of from about 0.10 to 0.30 inches and is constructed of a soft resilient polyproplyene. A thickness of less than 0.10 inches in most commercially available flexible materials generally is such that for use in a toilet seat handle, the material will be easily torn, will not last, or will "droop" in use. And, it is has been found that whenever utilizing soft, resilient flexible materials of greater than 0.30 inches in thickness, the material begins to be so thick that the problem to which the present invention is attempting to solve does not occur. That is, thicknesses of greater than 0.30 inches are usually more rigid than desired and thus, not sufficiently flexible when a user "bumps" into them. Thus, the preferred material is one of a thickness such that it will be of lasting and durable quality, but yet will be sufficiently flexible so when one bumps their leg into the material, it will bend, but in a normal situation will be sufficiently rigid so as to extend outwardly in a non-bending position. One such material is, for example, a flexible polypropylene. Moreover, the handle portion 14 includes a coating of illuminating material at selected portions thereon or therein that is visible or glows in the dark.

Even though the handle portion 14 is unitary with the base portion 12 as shown in FIGS. 1 and 2, a bendable connecting portion 30 is provided at the juncture of the handle portion 14 with the base portion 12. In the embodiment of FIGS. 1 and 2 the connecting portion 30 is of the same thickness as the handle portion 14 and the base portion 12, but is of a narrower width than either the handle portion 14 or the base portion 12. By being narrower than the base portion 12 or the handle portion 14, connecting portion 30 is the portion of the handle device 10 designed for bending, particularly in a horizontal direction upon impact by a user, such as a user's leg. Therefore, the connecting portion 30 is designed for bending horizontally upon impact of, for example, a user's leg. Preferably, connecting portion 30 moves horizontally upon impact by a force of from 0.1 to 1.0 pounds. Thus, for a handle device 10, having a thickness of from 0.10 to 0.30 inches, the connecting portion 30 will have its narrowest width of from 0.15 to 0.45 inches.

Figure 3:
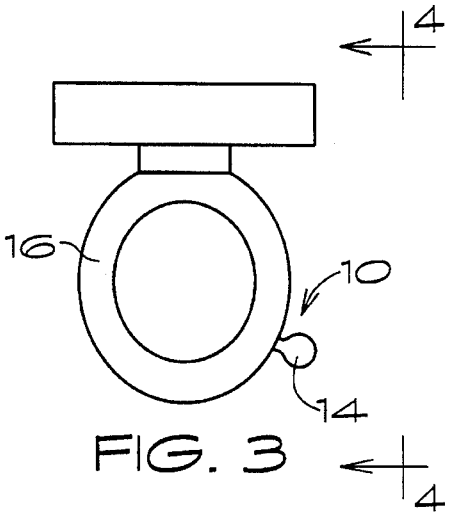
FIG. 3 is a top view of a toilet seat with a handle device of the present invention installed therein.

With reference to FIGS. 3 and 4 there is shown a typical toilet seat 16 pivotally mounted to a toilet bowl 18. Most commonly, the bottom side 20 of the toilet seat 16 has resilient support spacer bumpers 22 attached thereto which abut the toilet bowl rim when the toilet seat 16 is in the position overlaying the toilet bowl rim.

The handle device 10 is affixed to the toilet seat 16 at the base portion 12 of the handle device 10. Various fasteners can be used, however, preferably the base portion 12 of the handle device 10 is adhesively attached or affixed to the bottom side 20 of the toilet seat 16. Toward this end, the upper planar surface 13 of the base portion is provided with a coating 26 of a contact type adhesive material thereon. When the base portion of the device 10 is attached to the toilet seat 16, the handle portion 14 extends outwardly beyond the outside periphery of the toilet seat as can be best seen in FIG. 4. In use, one merely grasps the handle portion of the handle device 10 to raise or lower the seat 16, thus not physically coming in contact with the seat.

Figure 5:
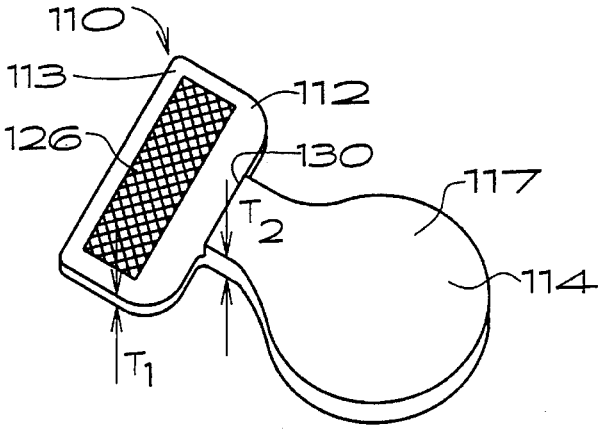
FIG. 5 is a perspective view of another preferred handle device of the present invention showing the top side of the handle device; and, FIG. 6 is a front view of a toilet seat with the handle device of FIG. 5 installed thereon.
Figure 6:
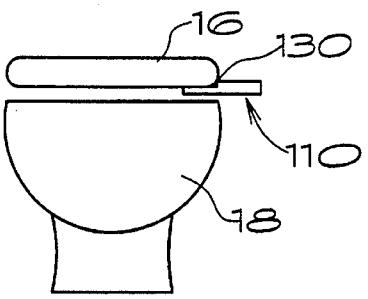

Another preferred handle device of the present invention, identified by the numeral 110, is shown in FIG. 5 wherein a handle portion 114 having an upper planar portion 117 is of a thickness $T_2$ which is thicker than the base portion 112, which has a thickness $T_1$. At the juncture of the handle portion 114 with an upper planar surface 113 of a base portion 112 is a ledge 130 which is positioned to abut an outer edge of a toilet seat 16, as shown in FIG. 6. The thickness $T_1$ is generally less than the height of bumpers 22 (FIG. 4) and the thickness $T_2$ is such that the handle portion 114 is movable horizontally upon impact by a force of from 0.1 to 1.0 pounds. In the embodiment of FIG. 5, $T_1$ is generally from 0.10 to about 0.20 inches and $T_2$ is from 0.15 to about 0.30 inches. And, the upper planar surface 113 is provided with a contact type adhesive material 126 thereon for attaching the underside of a toilet seat 16, as shown in FIG. 6.

The foregoing detailed description is given primarily for clearness of understanding and no unnecessary limitations are to be understood therefrom for modifications will become obvious to those skilled in the art upon reading this disclosure and may be made without departing from the spirit of the invention or the scope of the appended claims.

What is claimed is:

1. A toilet seat handle device for attachment to a toilet seat as an aid to raising and lowering the toilet seat comprising:

a base portion with upper and lower planar surfaces configured so as to fit with said upper planar surface against the bottom side of the toilet seat;

means for attaching the base portion to the bottom side of the toilet seat;

a flexible handle portion with upper and lower planar surfaces unitarily constructed with said base portion so as to have a first end affixed to said base portion and a second end extending outwardly from said base portion, the handle portion being thicker than said base portion and said lower planar surface of said base portion is in the same plane as the lower planar surface of said handle portion; wherein said handle portion is from 0.15 to 0.30 inches in thickness and said base portion is from 0.10 to 0.20 inches in thickness;

wherein at the juncture of the handle portion with the base portion the narrowest width at said juncture is from 0.15 to 0.45 inches;

including a ledge at the juncture of said handle portion with said base portion, said ledge configured to engage with a outer edge of a toilet seat;

and, wherein said handle portion is movable by a force of from 0.1 to 1.0 pounds against said handle portion.

2. The toilet seat handle of claim 1 wherein said handle portion includes a material that is visible in the dark.

3. The toilet seat handle of claim 2 wherein said handle portion is coated with an illuminating material.

4. The toilet seat handle of claim 1 is made of a flexible polypropylene material.

5. The toilet seat handle of claim 1 wherein the attaching means comprises an adhesive material.

* * * * *